United States Patent [19]

Chambers

[11] Patent Number: 4,470,774

[45] Date of Patent: Sep. 11, 1984

[54] VALVE PLATE ASSEMBLY FOR REFRIGERATION COMPRESSORS

[75] Inventor: Dale T. Chambers, Dayton, Ohio

[73] Assignee: Copeland Corporation, Sidney, Ohio

[21] Appl. No.: 318,052

[22] Filed: Nov. 4, 1981

[51] Int. Cl.[3] ..... F04B 21/02; F16K 15/02

[52] U.S. Cl. ..... 417/567; 137/543.19; 417/569

[58] Field of Search ..... 417/559, 563, 564, 566, 417/567, 569; 137/512.3, 514.5, 515.7, 535, 536, 543.19

[56] References Cited

U.S. PATENT DOCUMENTS

| | | | |
|---|---|---|---|
| 1,719,572 | 7/1929 | Stoll | 417/567 |
| 2,025,240 | 12/1935 | Higham | 417/571 |
| 2,613,870 | 10/1952 | Borgerd | 137/512.3 |
| 3,472,446 | 10/1969 | Linnert | 417/566 |
| 4,060,098 | 11/1977 | Bares et al. | 417/564 |

FOREIGN PATENT DOCUMENTS

| | | | |
|---|---|---|---|
| 2426378 | 1/1975 | Fed. Rep. of Germany | 417/562 |
| 1374783 | 11/1974 | United Kingdom | 298/ |

*Primary Examiner*—William L. Freeh
*Assistant Examiner*—Paul F. Neils
*Attorney, Agent, or Firm*—Harness, Dickey & Pierce

[57] ABSTRACT

An improved valve assembly and method of making same is disclosed which valve assembly is particularly well suited for use in refrigeration compressors. The valve assembly includes three plate members which may be easily stamped from sheet stock and which are assembled together and subjected to an oven brazing process to thereby provide a unitized valve plate having openings defining both suction and discharge valve seats.

10 Claims, 5 Drawing Figures

VALVE PLATE ASSEMBLY FOR REFRIGERATION COMPRESSORS

BACKGROUND AND SUMMARY OF THE INVENTION

The present invention relates generally to pressure responsive compressor valve assemblies and more particularly to such assemblies employing disc type valve members particularly adapted for use on refrigeration compressors.

The present invention is particularly well suited for use in combination with the disc-like lightweight valves of the type disclosed in assignee's copending application Ser. No. 971,309, filed Dec. 20, 1978 abandoned in favor of Ser. No. 219,849, filed Dec. 23, 1980 and assignee's copending application Ser. No. 318,155, entitled "Discharge Valve Assemblies For Refrigeration Compressors" filed of even date herewith and valve spring and guide arrangements disclosed in assignee's copending application Ser. No. 243,343, filed Feb. 13, 1981; application Ser. No. 234,169, filed Feb. 13, 1981; and assignee's copending application Ser. No. 318,055, entitled "Discharge Valve Assembly For Refrigeration Compressors" filed of even date herewith and represents an alternative to the valve plate assemblies of assignee's copending application Ser. No. 114,345, filed Jan. 22, 1980 and Ser. No. 114,346, filed Jan. 22, 1980. It may be used in both rotary and other types of compressors including single and multi-cylinder reciprocating piston type compressors of either hermetic or accessible hermetic type.

Valve plates and cylinder head assemblies can become relatively complex in configuration for certain valve arrangements and as a result may be quite costly to manufacture and sometimes to assemble.

The present invention provides an improved valve assembly which includes three separately fabricated valve plates which are designed to be assembled and furnace or oven brazed to provide a unitized valve plate assembly including openings defining both suction and discharge passages and suction and discharge valve seats. The three plates may be very easily and economically fabricated from sheet or plate material by stamping thereby substantially reducing the amount of high cost machining required and hence significantly reducing the cost of fabricating such valve plate assemblies. Additionally, because the three plates are separately fabricated, greater flexibility is afforded in designing the gas flow passages provided therein so as to facilitate optimization of the flow of both suction and discharge gas into and out of the compression chamber thereby facilitating the attainment of improved operating efficiencies. Also, because the three plates are furnace brazed to form a unitized assembly the need for additional gaskets between separate plate members is eliminated which reduces the possibility of leakage and final assembly of the compressor is facilitated as the valve plate is in the form of a unitized assembly.

Additional advantages and features of the present invention will become apparent from the subsequent description and the appended claims taken in conjunction with the accompanying drawings.

DESCRIPTION OF THE PREFERRED EMBODIMENT

Figure 1:
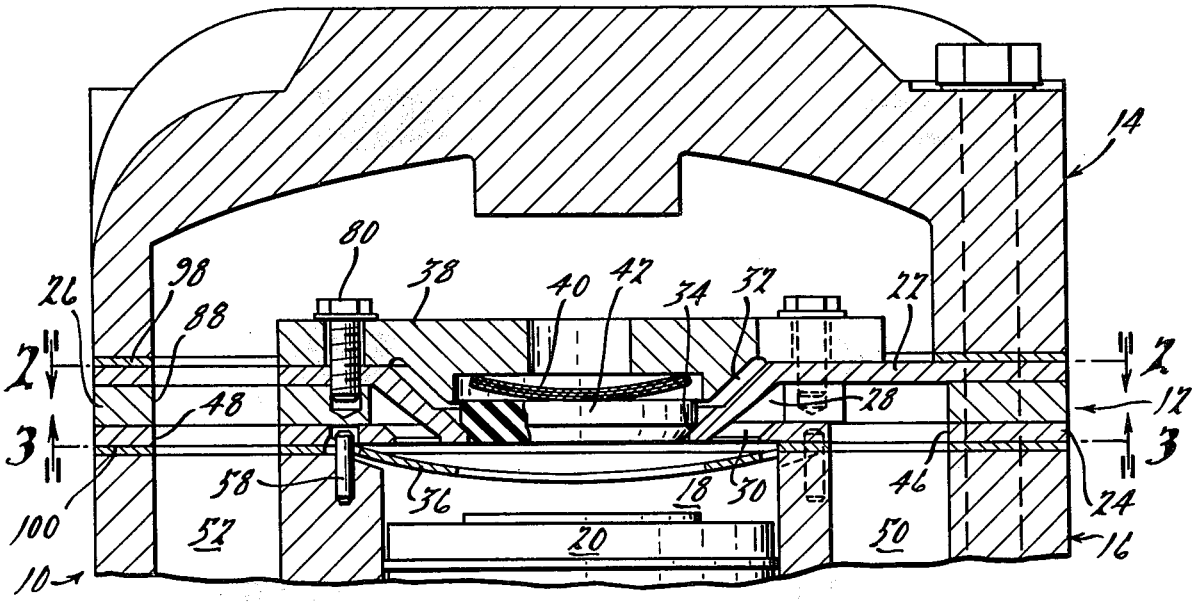
FIG. 1 is a fragmentary section view of a portion of a compressor showing a cylinder having a valve plate assembly in accordance with the present invention installed in operative relationship between the housing and head assembly, the section being taken generally along the line 1—1 of FIG. 2.

Referring now to the drawings and in particular to FIG. 1, there is shown a portion of a reciprocating piston type refrigeration compressor 10 having an improved valve assembly 12 in accordance with the present invention installed in operative relationship between a head 14 and housing 16 of the compressor 10. As shown, compressor 10 is of the reciprocating piston type and housing 16 contains a cylinder 18 within which a piston 20 is reciprocatingly disposed.

As shown therein, valve assembly 12 includes upper and lower valve plates 22 and 24 respectively and a center ring spacer plate 26 all of which are brazed together to form a unitized valve plate assembly and include appropriate openings defining a suction chamber 28, a suction gas inlet passage 30, a discharge gas passage 32 and a discharge valve seat 34. A ring type suction valve 36 (shown in an open condition in FIG. 1) is positioned to seat against the lower surface of valve plate assembly 12 and selectively close off suction gas inlet passage 30. A valve guide and spring retainer member 38 is secured to valve plate assembly 12 and includes a portion extending into discharge passage 32 within which a multi-leaf type spring 40 is positioned which is operative to bias a discharge valve 42 into a closed position against discharge valve seat 34. Preferably, the valve guide and spring retainer member will be of the type disclosed in assignee's copending application Ser. No. 318,055, entitled "Discharge Valve Assembly For Refrigeration Compressors", the discharge valve will be of the type disclosed in assignee's copending application Ser. No. 219,849, filed Dec. 23, 1980 and the multi-leaf spring will be of the type disclosed in assignee's copending application Ser. No. 243,343, the disclosures of which are hereby incorporated by reference.

The lower valve plate 24 is preferably stamped from suitable sheet or plate steel and for a multi-cylinder compressor has a generally oval shape as shown. A plurality of relatively large diameter suction inlet openings 44 are provided being positioned so as to be generally coaxial with the respectively cylinders 18 which they are to supply. Additionally, a pair of generally oval suction gas passages 46 and a circular discharge gas passage 48 are also provided which are adapted to overlie the suction gas passages 50 and discharge gas passage 52 provided in the compressor housing 16. A pair of relatively small openings 54 are also provided positioned outwardly from and on diametrically opposite sides of each of the suction gas inlet openings 44. These openings are adapted to accommodate locating retainer pins 58 which operate to locate and retain the ring type suction valves 36 in position as well as to position the valve plate assembly with respect to the cylinders as shown in FIG. 1 so that the suction and discharge gas passage will be generally coaxial therewith. In order to accommodate the flexing movement of the ring type suction valves 36, an elongated notch 60 defined by inclined sidewalls 62 and 64 is provided at each of the openings 54. Additionally, suitable openings 66 are also provided around the periphery of the lower valve plate to accommodate bolts for securing the valve plate assembly 12 and head 14 to the compressor housing 16.

Figure 5:
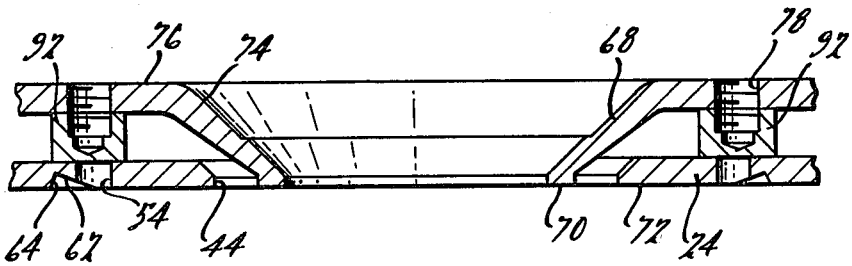
FIG. 5 is an enlarged fragmentary section view of the valve plate assembly of FIG. 1, the section being taken along line 5—5 of FIG. 2.
Figure 2:
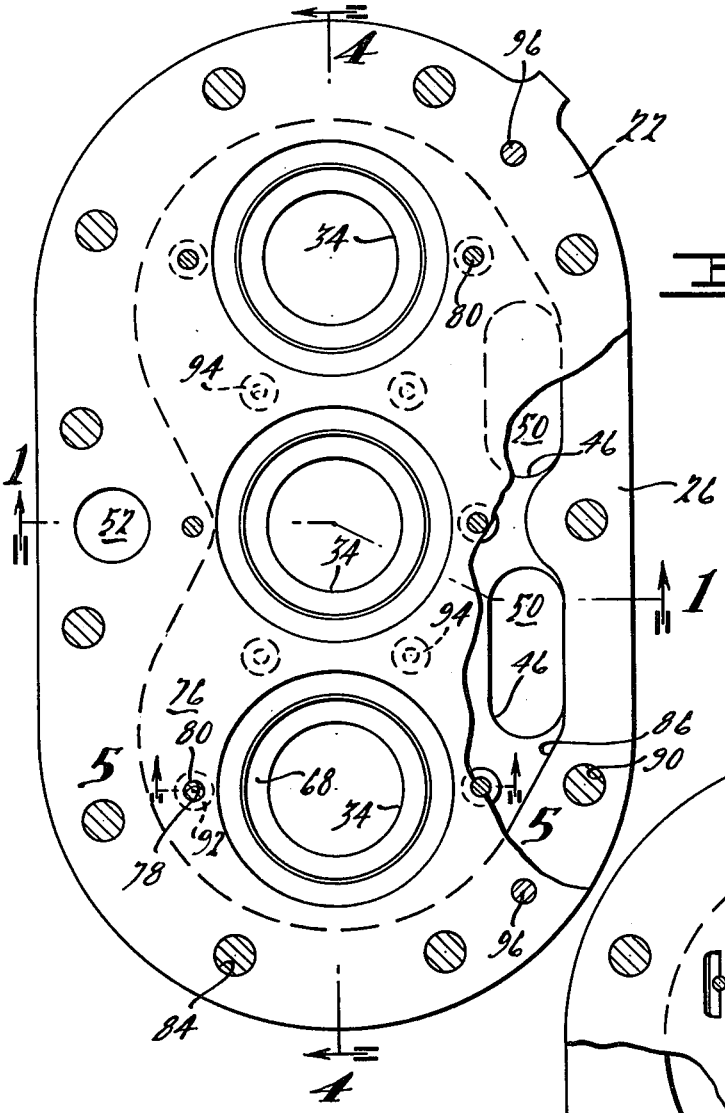
FIGS. 2 and 3 are section views of the valve plate assembly shown in FIG. 1 with portions thereof being broken away, the sections being taken along lines 2—2 and 3—3 respectively of FIG. 1.
Figure 3:
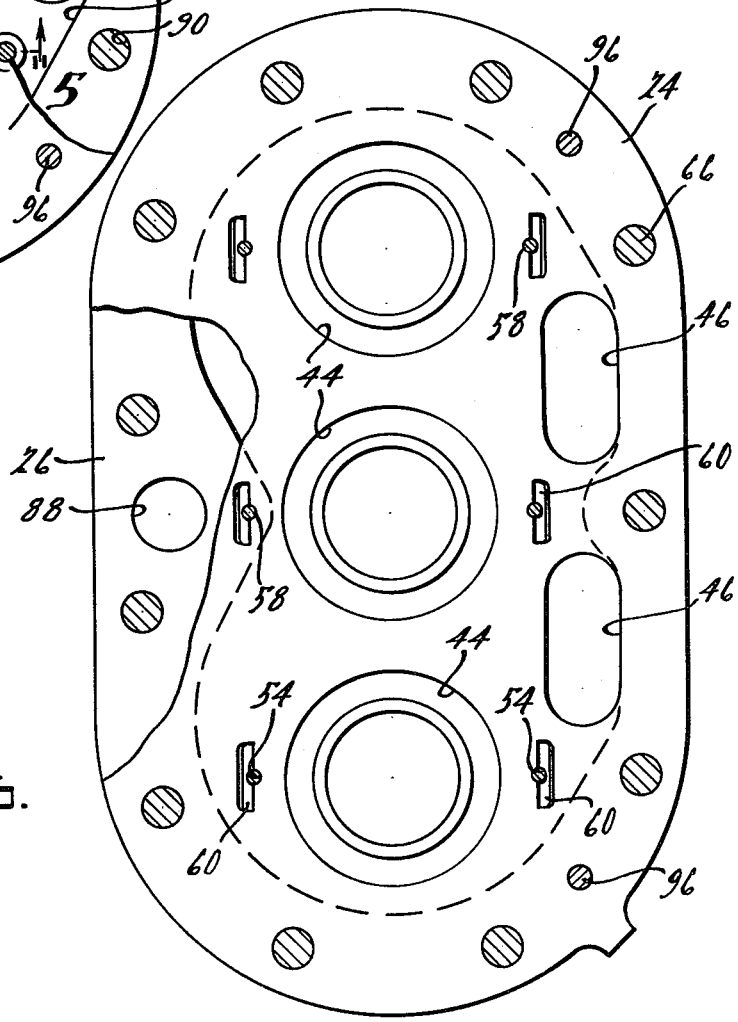

Upper valve plate 22 is also preferably stamped from plate or sheet steel and has an outer shape substantially the same as lower plate 24. Upper plate 22 has a plurality of generally conical shaped depending flange portions 68 the inner surface of which will define discharge passage 32 and discharge valve seat 34 and the outer surface of which will define in cooperation with lower valve plate 24 the suction inlet passage 30. As best seen with reference to FIG. 5, flange portion 68 has a length sufficient to position the lower edge 70 thereof in generally coplanar relationship with the lower surface 72 of lower valve plate 24 when assembled thereto and is generally coaxial with opening 44. It should be noted that the use of a stamping operation to form flange portions 68 will operate to provide a smoothly radiused juncture 74 with the upper surface 76 of valve plate 22 which will aid in efficient flow of gas out of discharge passage 32. Additionally, a pair of relatively small openings 78 are also provided positioned outwardly from and on diametric opposite sides of each of flange portions 68 which are designed to accommodate fasteners 80 for securing discharge valve guide and spring retainer member 38 to valve plate assembly 12. A discharge passage 82 is also provided therethrough which communicates with discharge passage 52 to conduct discharge gas from the head 14. Also a plurality of holes 84 are provided around the periphery to accommodate bolts for securing the head 14 and valve plate assembly 12 to the compressor housing 16.

Center ring spacer plate 26 is also preferably stamped from sheet or plate steel and has an outer shape generally the same as upper and lower valve plates 22 and 24. A large irregular shaped opening 86 is provided in center ring spacer plate 26 which operates to define suction chamber 28 between the upper and lower valve plates 22 and 24 and to place suction passages 30 provided in lower valve plate 24 in fluid communication with the suction passage 50 in compressor housing 16. It should be noted that suction chamber 28 defined by center ring spacer plate 26 operates to provide a significant volume of suction gas from which each of the pistons may draw in addition to that entering through passage 50 and thus may contribute to improved breathing of the compressor. A discharge opening 88 and suitable bolt holes 90 are also provided around the periphery thereof.

In order to provide means for securing valve guide and spring retainer member 38 to valve plate assembly 12, a plurality of generally cylindrical lugs 92 are provided between upper and lower valve plates 22 and 24 having upwardly facing drilled and tapped openings therein aligned with respective openings 78. It should be noted that in addition to providing fastening means for receiving retainer member securing bolts 80, lugs 92 also are positioned to overlie and seal off the locating pin openings 54 provided in the lower valve plate 24 so as to prevent leakage of compressed discharge gases from cylinder 18 into the suction chamber 28. While valve guide and spring retainer member 38 will preferably be of the type disclosed in assignee's copending application Ser. No. 318,055, entitled "Discharge Valve Assembly For Refrigeration Compressors" and filed of even date herewith or assignee's copending application Ser. No. 318,155, entitled "Discharge Valve Assembly For Refrigeration Compressors" and also filed of even date herewith, the bridge or retainer members disclosed in application Ser. No. 234,169, filed Feb. 13, 1981 may also be used if desired.

Figure 4:
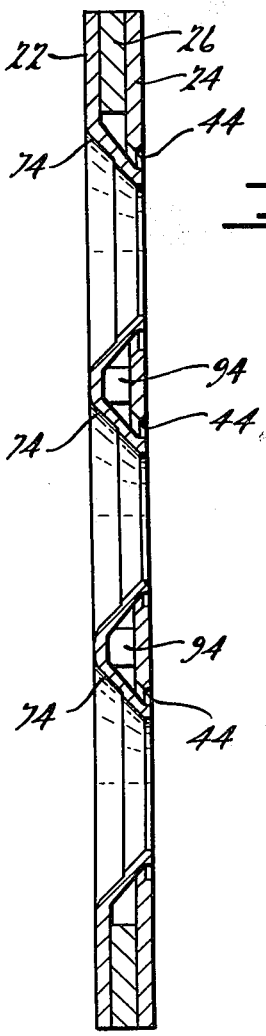
FIG. 4 is a section view of the valve plate assembly of FIG. 1, the section being taken along line 4—4 of FIG. 2.

It should also be noted that in some cases it may be desirable to provide several additional lugs 94 interposed between the upper and lower valve plates 22 and 24 to provide support therebetween such as is shown in FIG. 4. Suitable small pilot pins may be provided thereon which pins may be received in small openings in the upper plate to maintain them in position during assembly and oven brazing of the plates.

In assembling the valve plate assembly 12 of the present invention, the mating surfaces of each of the plates 22, 24, and 26 will be provided with a coating of copper paste and flux or other suitable sources of brazing material fitted together and the assembly then subjected to an oven or furnace brazing process. It should be noted that copper paste is also applied to the holes provided in the lugs so as to prevent hardening of the lug material during a subsequent hardening processing step. In order to maintain the upper, lower, and center plates 22, 24, and 26 in proper alignment during the oven brazing operations, a pair of suitable pins 96 are inserted through aligned openings provided in the plate members. Thereafter, the assembly will be subjected to a suitable hardening process to improve the wear characteristics of the valve seats and to facilitate subsequent grinding of the discharge valve seats. The upper and lower surfaces of respective upper and lower plates 22 and 24 are then ground parallel, the discharge valve seat is finish ground and lugs 92 are tapped. Discharge valve 42, springs 40 and retainer member 38 may then be assembled to the valve plates and secured thereto by bolts 80 to complete the valve plate assembly.

Because the valve plates and discharge valve are fully assembled as a unitized brazed valve plate assembly, it is a relatively simple procedure to install it in the compressor along with the suction valve 36 and suitable upper and lower gaskets 98 and 100. No additional intermediate gaskets are required because the individual plates are fully secured and sealed together by the oven brazing process thus the possibility of leakage is substantially reduced. Also, because each of the three required plates may be individually formed by a stamping process with very little machining required, the cost of manufacturing such valve plate assembly is significantly reduced. It should also be noted that in addition to being easily and inexpensively fabricated, the valve plate assembly offers an improved flowpath arrangement in that discharge gas flowing through the conical discharge passage passes directly into the discharge chamber provided in head 14 without impacting against a vertically extending sidewall as in prior designs.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A refrigeration compressor comprising:

a housing including means defining a compression chamber;

a head assembly; and a valve plate assembly secured between said head assembly and said housing, said valve plate assembly including a spacer plate member having first and second plate members secured to opposite substantially coextensive parallel surfaces thereof with said spacer plate extending around the periphery of said first and second plate members so as to define a substantially closed suction chamber therebetween, a plurality of spacer lugs within said suction chamber extending between said first and second plate members and spaced from said spacer plate member, one of said first and second plates including a depending annular flange portion extending through said suction chamber and an opening in the other of said first and second plates and cooperating therewith to define separate concentric suction and discharge gas passages through said plate assembly.

2. A refrigeration compressor as set forth in claim 1 wherein said depending flange portion is conically shaped.

3. A refrigeration compressor as set forth in claim 1 further comprising a discharge valve movably positioned within said discharge passage, guide means extending into said discharge passage for guiding movement of said discharge valve and means for securing said guide means to said valve plate assembly.

4. A refrigeration compressor as set forth in claim 1 wherein said spacer plate and said first and second plates are brazed together.

5. A refrigeration compressor as set forth in claim 1 wherein said first and second plates are stamped from sheet stock.

6. A refrigeration compressor comprising:

a housing including means defining a compression chamber;

a head assembly; and a valve plate assembly secured between said head assembly and said housing, said valve plate assembly including a spacer plate member having first and second plate members secured to opposite substantially coextensive parallel surfaces thereof so as to define a suction chamber therebetween, one of said first and second plates including depending annular flange portion extending through said suction chamber and an opening in the other or said first and second plates and cooperating therewith to define separate concentric suction and discharge gas passages through said plate assembly; a discharge valve movably positioned within said discharge passage, guide means extending into said discharge passage for guiding movement of said discharge valve and means for securing said guide means to said valve plate assembly including fastener receiving lug means positioned within said suction chamber and between said first and second plate members and fastener means extending through said one plate member into engagement with said lug means.

7. A refrigeration compressor as set forth in claim 6 further comprising pin receiving openings extending through said other plate member into said suction chamber and said lug means being positioned in overlying relationship to said openings to prevent fluid communication therethrough.

8. A refrigeration compressor comprising:

a housing including means defining a compression chamber therein and suction and discharge gas passage means, a valve plate assembly including a first plate overlying said compression chamber and having openings communicating with said suction and discharge gas passage means and a suction inlet opening communicating with said compression chamber;

a ring spacer plate engaging said first plate and having an opening defining a suction chamber for receiving suction gas from said suction gas passage and supplying same to said suction inlet opening, a second plate overlying said ring spacer plate and said suction gas passage and having an opening communicating with said discharge gas passage, said second plate including a conical depending flange portion extending through said suction inlet opening and cooperating therewith to define a suction inlet passage for said compression chamber, said flange portion also defining a concentric discharge passage, a discharge valve movably positioned within said discharge passage; and valve guide and biasing means extending into said discharge passage, a plurality of spacer lugs disposed within said suction chamber and extending between said first and second plates;

fasteners extending through said second plate into engagement with selected ones of said lugs for securing said valve guide and biasing means to said valve plate assembly, said first and second plates being secured to opposite sides of said ring spacer, and means securing said head and said valve plate to said compressor housing.

9. A refrigeration compressor as set forth in claim 8 wherein said first and second plates fixedly secured to opposite sides of said ring spacer.

10. A refrigeration compressor as set forth in claim 8 wherein said first and second plates are stamped from sheet metal stock.

* * * * *